US009089962B2

(12) United States Patent
McCarty, II et al.

(10) Patent No.: US 9,089,962 B2
(45) Date of Patent: Jul. 28, 2015

(54) ANTI-SPALLING COMBINATION ON AN IMPACT TOOL WITH AN IMPROVED HOLDING SYSTEM

(75) Inventors: H. Downman McCarty, II, Whitehall, MD (US); Brooke Schumm, III, Ellicott City, MD (US); Peter Popper, Wilmington, DE (US)

(73) Assignee: Hard Cap Technologies, LLC, Bozeman, MT (US)

( * ) Notice: Subject to any disclaimer, the term of this patent is extended or adjusted under 35 U.S.C. 154(b) by 2160 days.

(21) Appl. No.: 10/625,149

(22) Filed: Jul. 23, 2003

(65) Prior Publication Data

US 2004/0016330 A1 Jan. 29, 2004

Related U.S. Application Data

(63) Continuation-in-part of application No. PCT/US02/23448, filed on Jul. 23, 2002.

(60) Provisional application No. 60/307,198, filed on Jul. 23, 2001, provisional application No. 60/356,804, filed on Feb. 13, 2002.

(51) Int. Cl.

| | |
|---|---|
| ***B26B 7/00*** | (2006.01) |
| ***B25G 1/01*** | (2006.01) |
| ***B25D 1/16*** | (2006.01) |
| ***B25D 3/00*** | (2006.01) |

(52) U.S. Cl.

CPC .. *B25G 1/01* (2013.01); *B25D 1/16* (2013.01); *B25D 3/00* (2013.01)

(58) Field of Classification Search

USPC ..... 30/277, 167–170, 173, 174, 317, 165; 7/165, 103; 81/436; 16/431

See application file for complete search history.

(56) References Cited

U.S. PATENT DOCUMENTS

| | | | | |
|---|---|---|---|---|
| 1,409,638 | A * | 3/1922 | Zetterman | 30/167 |
| 3,320,986 | A * | 5/1967 | Jeffery et al. | 30/167 |
| 3,842,942 | A * | 10/1974 | Jensen et al. | 181/207 |
| 4,497,355 | A * | 2/1985 | Smith | 30/167 |
| 4,872,231 | A * | 10/1989 | Gustavsen | 7/103 |
| 4,875,289 | A * | 10/1989 | Poling | 30/167 |
| 5,433,005 | A * | 7/1995 | Cogdill et al. | 30/164.7 |
| 5,953,820 | A * | 9/1999 | Vasudeva | 30/125 |
| 6,076,431 | A * | 6/2000 | Vasudeva | 81/44 |
| 6,769,182 | B1 * | 8/2004 | McCabe | 30/164.6 |

* cited by examiner

*Primary Examiner* — Omar Flores Sanchez

(74) *Attorney, Agent, or Firm* — Brooke Schumm, III; Daneker, McIntire, Schumm, Prince, Manning & Widmann, P.C.

(57) ABSTRACT

The invention is a tool to be struck, or a striking tool, (collectively referred to as an "impact tool"), or alternatively, a cap, that will not suffer metal spall and the attendant dangers of spalling and flying or cutting metal slivers. The preferred mode is on a chisel (wood or cold) or repeated impact tool. The chisel would have a striking end cut square to the shaft. The striking end would be opposite the working end. Other tools such as impact wrenches, jackhammers, wedges, spikes, hammers, mallets or other tools being struck or striking forcibly benefit from the invention by use of a disk insert of polymeric material to alter ergonomic and noise characteristic.

21 Claims, 10 Drawing Sheets

PRIOR ART IN CROSS-SECTION

DISK
CROSS-SECTION

ANTI-SPALLING COMBINATION ON AN IMPACT TOOL WITH AN IMPROVED HOLDING SYSTEM

CONTINUATION DATA

For purposes of the United States, this is a continuation in part of PCT/US02/23448 filed on Jul. 23, 2002 and entry into the national stage of PCT/US02/23448 filed in the United States as Receiving Office, which PCT Application PCT/US02/23448 in turn is a continuation in part of provisional applications filed on Jul. 23, 2001 Nos. 60/307,198, and 60/356,804 filed on Feb. 13, 2002, both filed in the United States.

SUMMARY OF INVENTION

The inventors have designed a tool to be struck, or a striking tool, (collectively referred to as an "impact tool"), or alternatively, a cap, that will not suffer metal spall and the attendant dangers from noise and from spalling and flying or cutting metal slivers. The noise production characteristics of impact of an impacting tool (such as a ram or hammer) striking a tool to be struck, or of the tool to be struck can be modified. By further modifying the working end of the tool, impact effectiveness can be maintained.

The preferred mode is on a chisel (wood or cold) or any tool which is struck or rammed repeatedly. The chisel would have a striking end cut square to the shaft. The striking end would be opposite the working end. Other tools such as impact wrenches, jackhammers, wedges, spikes, hammers, mallets or other tools being struck or striking forcibly benefit from the invention. In each of these tools having an interchangeable working end, the end which contacts the material worked is the working end and the opposite end from that working end is the striking end. For a tool such as a jackhammer or impact wrench, generally referred to as an impacting tool, the working end of the tool which rams or strikes the working end is the impacting end.

The key benefit of the invention relates to protection of the tool and more importantly, the worker, from attendant noise, fatigue, spalling and its consequences. For a striking tool, a disk would be positioned above and on the striking end of a diameter approximately equal to the diameter of the striking end or the diameter of the end of a striking tool, such as a hammer, whichever diameter is less. The disk would be made of a material which would not spall or shatter and would still effectively perform the designated task. The disk would be preferably secured by a cap with an aperture to accommodate the disk made of a less expensive material with a lower modulus and good impact resistance. The disk protects the end of the tool from spalling. For an application involving an impacting tool with an interchangeable working end, a disk would be positioned in between the impacting end and the striking end of the interchangeable working end.

Replacement of such disk or other shape would be contemplated. Alternatively the material could be more fully and more permanently integrated into the striking end of a striking tool or the impacting end of an impacting tool or both. Selection of polymers and polymeric composites can be made to include lubricity characteristics. A system for automated impacters or automated repeat impacters includes polymers, polymeric composites and/or metals inserted between impacting end of the impacter and the striking end of a striking tool. This arrangement will reduce vibrations, noise, and improve ergonomics.

PRIOR ART BACKGROUND

Prior art: The most relevant prior art is seen in three tools marketed in various retail outlets (FIG. 1). The first is a tool (Tool 1 of FIG. 1) inserted into a grip. This tool does not solve the problem of spalling, but is comfortable for the hand and can furnish some hand protection. Tool 2 of FIG. 1 has high transmission of force and some hand-holding advantages, but furnishes no solution to the problem of spalling after substantial use. Tool 3 of FIG. 1 is a less complex and less protective version of Tool 1 of FIG. 1.

OBJECTS OF THE INVENTION

Figure 1:
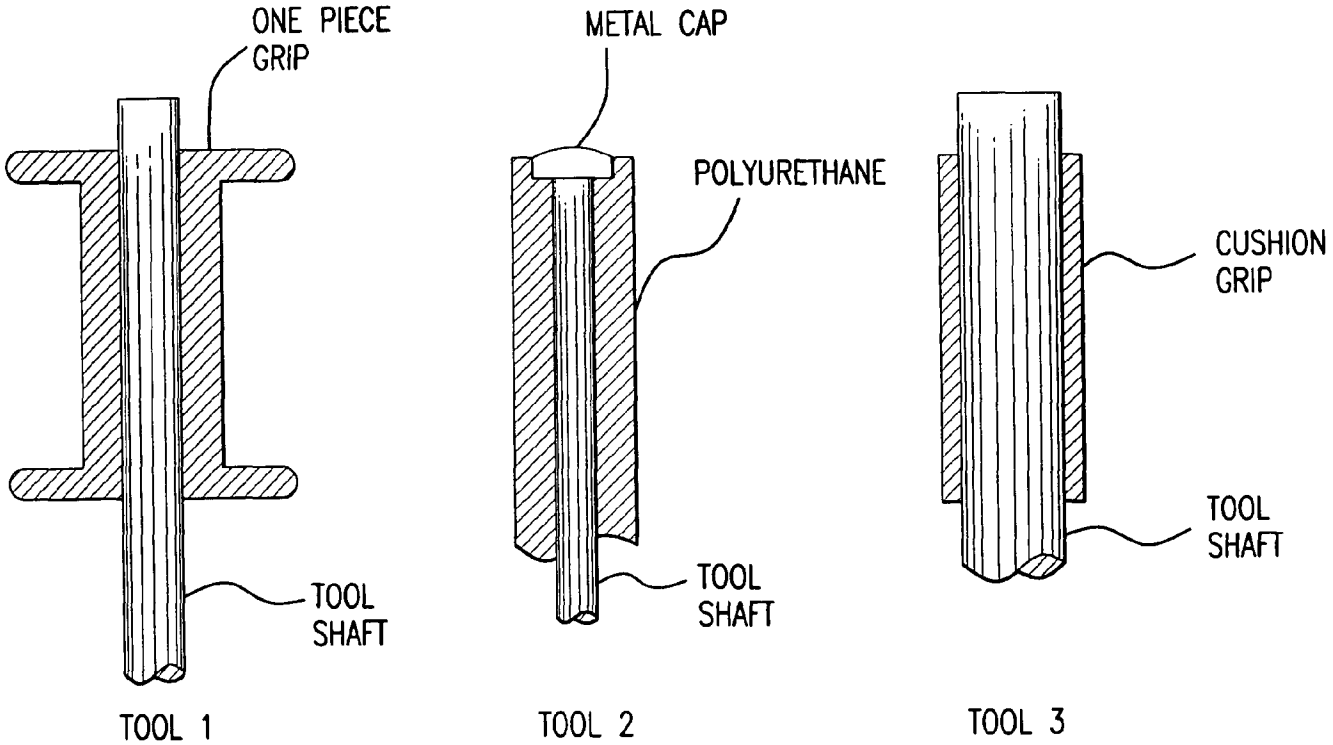
FIG. 1 shows three tools marketed in various retail outlets. The first is a tool (Tool 1 of FIG. 1) inserted into a one-piece grip. Tool 2 of FIG. 1 shows a tool with a metal cap and polyurethane grip which has high transmission of force and some hand-holding advantages, but furnishes no solution to the problem of spalling after substantial use. Tool 3 of FIG. 1 is a less complex and less protective version of Tool 1 of FIG. 1.

One object of the invention is to prevent injury by limiting or eliminating spalling, mushrooming, and chipping.

Another object is to increase the longevity of the impact tool.

Another object is to reduce the noise and thereby reduce aural hardship on a user of the impact tool.

Another object is to accomplish the above objects without significantly reducing the cutting effectiveness or impacting effectiveness of the tool compared to the same tool without the invention applied to the tool.

Another object is to reduce biomechanical and neurological damage to the arm through attenuation of impact shock.

Another object is to enable detection of potential catastrophic failure of the tool because cracks or defects will be seen before catastrophic failure.

PREFERRED MODE OF INVENTION

The preferred mode of invention is applicable to any tool used for impact applications. Such tool is generally referred to as an impact tool, and includes tools that are impacted or struck, or tools that impact and strike, such as a hammer, or an automated repeating impact tool such as a jackhammer.

As related in the summary above, the basic design of several preferred modes is useful for understanding the scope of the invention. The basic and a first preferred mode which illustrates the basic principles of the invention is on a tool to be struck such as a chisel (wood or cold). A wedge is another suitable mode of employment of the invention. The chisel would have a striking end cut square to the shaft. The striking end would be opposite the working end. The chisel is illustrative of the first preferred mode involving tools to be struck. Other examples are wedges and spikes.

For a striking tool, a disk would be positioned above and on the striking end. There are two contemplated applications. First is to select a disk of a diameter approximately equal to the diameter of the striking end or the diameter of the end of a striking tool, such as a hammer, whichever diameter is less. The disk would be made of a material which would not spall or shatter and would still effectively perform the designated task. The disk would be preferably secured by a cap with an aperture to accommodate the disk made of a less expensive material with a lower modulus and good impact resistance. This latter material would be a spall-inhibiting material. Spall-inhibiting material includes a material that is resistant to splintering or generating peeling slivers or mushrooming, and includes resistant to sharp shattering and splinters that erupt on impact. Generally, in the preferred mode, such a spall-inhibiting material will be softer and less durable than the shaped polymeric material being selected for impact. Similarly, such a spall-inhibiting material will tend to be cheaper as well. It would be designed to withstand indirect hits, with the direct hit being applied to the disk.

The disk protects the end of the tool from spalling. The material contemplated in the disk will be discussed momentarily.

The second application is to utilize a disk or cap secured to the striking end of the tool to be struck which does not spall or shatter and still effectively performs the designated task.

A second class of tools in the preferred mode involves tools which are impacting tools. The first portion of this class are impacting tools such as hammers and mallets which may or may not have interchangeable ends which effect the impact. The second portion of this class are tools impacting tools involving repeated impacting such as impact wrenches and jackhammers. For impacting tools in this second preferred mode, such as hammers, jackhammers or impact wrenches, the working end of the tool which rams or strikes the working end is the impacting end.

The key benefit of the invention relates to protection of the tool and more importantly, the worker, from attendant noise, fatigue, spalling and its consequences.

For an application involving an impacting tool with an interchangeable working end, a disk or inserted material would be positioned in between the impacting end and the striking end of the interchangeable working end.

A person of reasonable skill in tool-making will understand that as to impact wrenches, there is no working end in the sense of a chisel, rather, the reference to working end in this invention is to the portion of the impact wrench encompassing the nut, driving the screws, or encompassing or driving any other item being turned into place. The impacting end in that application to an impact wrench is the driving end to that portion of the impact wrench contacting the item or items being turned into place. An impact tool may include a repeating impacting tool including a jackhammer and applicable accessory tools. As to jackhammers, normally the bit or working portion of the jackhammer is interchangeable. In a jackhammer, the width of the later described disk would normally be coincident with the diameter of the shaft of the interchangeable working portion of the jackhammer.

In the preferred modes, the inventors prefer specifically a disk or inserted material (both collectively referred to as a "disk") with favorable modulus attributes, preferably made of DuPont MINLON (™), as later described, would be positioned above and on the striking end. The disk would be of a diameter approximately equal to the diameter of the striking end or could be the diameter of the end of a striking tool, such as a hammer, whichever diameter is less. The most preferred form of MINLON is 11C40 sold by DuPont Engineering Polymers, Chestnut Run Plaza 713, P.O. Box 80713, Wilmington, Del. 19880-0713. MINLON material would not spall or shatter. The material would still effectively perform the designated task while protecting the shaft of the chisel, meaning that the number of impacts to fail a standard rod or perform a standard task would not increase by more than 40%. For instance, for a drill rod cut on average by 10 strokes by a hammer applied to a chisel, with the chisel modified by this invention, the number of strokes by the same hammer under the same conditions would average 14 or less. The disk would be preferably secured by a cap with an aperture to accommodate the disk made of a less expensive material with a lower modulus and good impact resistance. The disk could be secured by adhesive or by the extrusion of the less expensive material around the disk. The disk protects the end of the tool from spalling. MINLON is a fiber reinforced polymeric material, reinforced with mineral fiber.

Replacement of such disk or other shape would be contemplated. Alternatively the material could be more fully and permanently integrated into the striking end of a striking tool or the impacting end of an impacting tool or both. Selection of the polymeric material from the classes of polymers and polymeric composites can be made to include lubricity characteristics. A system for automated impacters or automated repeat impacters includes polymeric material including polymers, composites and/or metals, preferably fiber reinforced, inserted between the impacter's impacting end and striking end of a striking tool. This arrangement will reduce vibrations, noise, and improve ergonomics.

Substantial noise reduction while substantially preserving striking force is enabled by the invention. For purposes of a striking tool, the disk is on the striking face of the hammer or mallet and, in the preferred mode, secured to the striking tool by a cap or adhesive, or by a fitted shape into for instance a metal hammer.

The invention is also applicable to a spike such as a railroad spike where the invention enables quieting of noise and reduction of spalling without significantly impairing effectiveness of penetration.

Impact effectiveness is defined as the ratio of a numerator of the number of blows to achieve a result without the shaped polymeric material disposed on the striking end of an impact tool over a denominator of the number of blows to achieve a result with a shaped polymeric material disposed on the striking end of the same impact tool.

The preferred mode of the invention involves the use of material having sufficient modulus to enable adequate impact effectiveness with sufficient impact resistance to avoid irreversible deformation or fracture upon repeated impact.

The modulus is the ratio of a line or curve on a graph. One axis of the graph is stress measured in force per unit area (the stress can be push or pull), and the other axis is the ratio of the length of a selected standard material under stress divided by the original length of the selected standard material when there is no stress on it. Materials which do not have much distortion in length when under much stress tend to transmit energy or force in a higher ratio than materials which do distort when under stress.

The shape is selected for durability and sound diminution while preserving impact effectiveness. The invention enables selection of materials that cause a frequency shift in sound so that impact noise can not only be attenuated in terms of intensity in decibels, but what sound does emerge is emitted at different and usually lower frequencies that the high-pitched metallic sound that is more bothersome to an impact tool user.

One of the novel characteristics of using MINLON in the invention is that the noise vibration is transformed from the more irritating and harmful high-frequency ping to one or more lesser frequency noises that have a less strident and more tolerable effect on the human ear. Similarly, a more rapid frequency vibration for a hand-held tool can be distributed to a lower and more ergonomically favorable frequency range.

The frequency response of the entire system with added polymer and/or metal, may be "retuned" to minimize the energy at frequencies damaging to the human ear. This could be done by modifying the length or cross section of the moving components.

Impact resistance involves a standard test which essentially measures the brittle quality of a material. In the traditional steel cold chisel, the modulus is very significant meaning most of the force with which the chisel is hit on the striking end is applied to the working end of the chisel. However, the disadvantage is that the impact resistance of steel is not as favorable as MINLON because the steel deforms and unfortunately deforms permanently yielding mushrooming, or spalling, and potentially chipping all of which are dangerous to the user.

In the more general class of polymeric material, the inventors prefer the use of a thermoplastic resin or polymer, or a thermosetting resin or polymer for the disk. As stated, the preferred material for application in the invention is a mineral or fiber reinforced polyamide, including reinforcement by glass, or carbon. More preferably, a mineral or mineral/glass-reinforced polyamide such as Nylon 66, and most preferably MINLON is preferred. The type of MINLON thermoplastic resin selected is MINLON 11C40. The cap can also be of MINLON, but is preferably of a less expensive material. Such cap material, selected by one reasonably skilled in the art, need only sustain incidental impacts. The inventors have selected ADIPRENE produced by UniRoyal Chemical, cataloged as LF 753D for the cap material to hold the MINLON disk. For that cap material, it is more important to have impact resistance than modulus.

More specifically, the preferred material for the disk, or if the cap is to be composed of one substance, for the entire cap, is MINLON 11C40 (for convenience called "MINLON"). MINLON is a mineral and mineral-fiber reinforced Nylon 66 composite sold under the trademarked name of MINLON by DuPont Corporation of Wilmington, Del. The preferred thickness of the disk 0.170 inches, but can be slighter greater. If the entire cap is to be of one compound, as opposed to merely the disk, the most preferable materials from which to manufacture the cap are going to be fiber reinforced polymers. If the disk is used, the most preferable materials for the disk are also going to be fiber reinforced polymers. For the cap over disk application, the cap has a thickness of 0.150 inches and the disk should be protruding above the end of the shaft of an impact tool. The preferred overshot is approximately 0.020 inches. The inventors preferred mode is for an overshot of approximately 0.015-0.020 inches, whatever the underlying thickness of the disk. The material selected by the inventors in their most preferred mode for the cap surrounding the disk is ADIPRENE (™), cataloged as LF 753D. The product is marketed by Uniroyal Chemical Urethane Technology Group is part of Crompton Corporation, 199 Benson Road, Middlebury, Conn. 06749. The cap to hold the disk can be made of any number of polymers, with preference to polyamides and polyurethanes. The key is a cheaper material than MINLON, such as ATAPRENE, HYTRIL, PELRIN, NYLON, polypropylene, or DACRON.

The calculus for the disk is generally to apply a formula of the modulus times the area of cross-section of the disk divided by its thickness and to use a value high enough to preserve an impact effectiveness of at least 75%. In a layman's terms, the higher the modulus, the tougher and more expensive the material, as a rule, the thicker it is, the more absorption of impact will occur through deformation and springiness, and the larger the area, which is preferred to be the size of the shaft, the thinner the material can be or the lower the modulus. The disk on many tools needs to be large enough that the cap or grip are not struck and degraded by off center impacts. For a cap entirely composed of MINLON, edges should be rounded, particularly an edge that is adjacent to the cap portion surrounding the circumferential end of the tool as it rounds to a circular area that is wider than the shaft and surrounding circumferential portion of the cap.

More generally, for use in the invention, the term polymeric material includes the use of fiber-reinforced polymeric composites. Davies et al, U.S. Pat. No. 5,750,620, May 13, 1997 discloses much of this family of polymeric material to which this invention refers. More generally, the polymeric material in this invention includes one or more compounds selected from the group of polymeric compounds having a structure such that the intermolecular distance of the structure corresponds to the intermolecular distance of the fiber crystal structure such that upon melting of said polymeric compound in the presence of the fiber, the combination results in reinforcement of the polymeric compound. Further, the polymeric material in this invention refers to all thermoplastic structural composite materials and blends of those thermoplastic structural composite materials reinforceable by continuous fibers including fibers with various interweaves or surface activity (shaping). Many examples of these thermoplastic structural composite materials and fiber interplay, as well as manufacturing techniques, are set out in "Thermoplastic Aromatic Polymer Composites: a study of the structure processing and properties of carbon fibre reinforced polyetheretherketone and related materials," Frederic Neil Cogswell (Butterworth Heinemann Publishers Ltd. 1992). Of considerable interest are fiber reinforced materials in the "Victrex" range of polymers from ICI, particularly polyethersulphone, polyphenylene sulfide, and polyetheretherketone, and the fiber reinforced nylon materials. The Victrex range of polymers are described as materials whose members are based on separating rigid aromatic units with either flexible or stiff linkages, usually ether or ketone. One of these compounds, or one or more of these compounds together is included in the description polymeric material.

The polymeric material may be and should be reinforced by generally longitudinal fibers or by more circular or bone shaped continuous fibers The ends of the fiber need not necessarily be connected but may closely overlap. Short fiber reinforced composites are also suitable for the preferred modes of this invention. The reinforcing material is usually carbon fiber, mineral or glass fiber. Other reinforcing fibers for polymeric composites, such as aluminum, are well-known in the art and covered by this invention. Generally, the concept is and the term continuous fiber includes, generally longitudinal fibers or more circular or bone shaped continuous fibers recognizing that the ends of the fiber need not necessarily be connected but may closely overlap. Carbon or glass fiber may preferably be used, though the invention is not limited to just those fibers. The fiber selected must be such that upon melting with the selected polymeric compound, the combination results in results in reinforcement of the polymeric compound.

Polyetheretherketone (commonly referred to as "PEEK") is the most preferable for flexural strength applications. Polyetheretherketone is an aromatic polymer whose construction consists of ether, ketone, and phenyl groups. Polyetherketoneketone is a close cousin (commonly referred to as "PEKK"). Unfilled and unreinforced polymeric composites generally have a low coefficient of friction and exhibit self-lubricating character but usually lack the strength and rigidity necessary for the contemplated application. By reinforcing the polymeric material with short or long fibers, including in various shapes, or a continuous carbon fiber, the material becomes significantly stronger. Certain materials also have self-lubricating character which is useful in the tools involving repeating impacting such as a jackhammer. A carbon Fiber reinforced polymeric composite such as PEEK or polyphenylene sulfide (commonly known as "PPS") or polyethersulfone ("PES") also maintains these characteristics at sliding contact speeds making it suitable for unlubricated operations. Polymeric composite can be laminated and formed similarly.

Because of the hardness of the material, an optimal method of manufacturing is to cure the material in a mold that results in rouletting of the sheets so they can be parted into the selected shape more easily.

The bias of the fibers can be alternately set to provide a specific flexural strength, coefficient of thermal expansion, lubricity, and/or wear. Better tribological properties are gained by having the ends of the fibers as close to perpendicular to the sliding contact surface as possible. Better wear properties are gained by having the fibers parallel to the sliding contact surface. The coefficient of thermal expansion also can be tuned through selective orientation of the fibers in multiple plys since the longitudinal expansion is an order of magnitude smaller than the transverse. The preferred mode is a compromise that maintains sufficient flexural strength to resist foreign impact damage but minimizing the wear rate while matching the thermal expansion of the surrounding device.

Also contemplated are layers of metallics, or metallic impregnated polymerics referred to above, in conjunction with another layer of polymeric compound selected for the combination of flexural strength, durability and any necessary lubricity. High strength metals such as titanium could be used.

A variety of adhesives may be used to secure in an impact tool such layered object to diminish noise while preserving impact effectiveness.

Also contemplated is a two or three dimensional mesh of a high strength metal in conjunction with a melting in one or more polymeric compounds in composition into said mesh. The reverse process of one or more high melting point polymeric compounds or polymeric composites in mesh form into which metal with a lower melting point is bled is also contemplated.

Figure 3A:
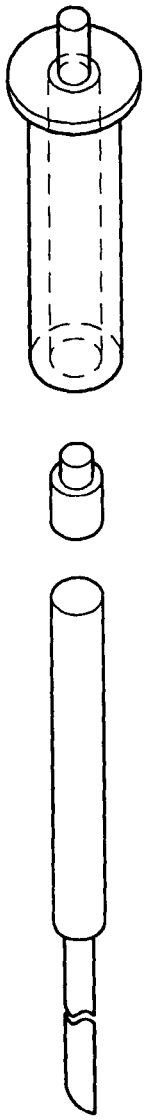
FIGS. 3A, 3B, and 3C show a tool with a disk with a sort of football or curved conical perimeter which fits into and under the cap as shown in FIGS. 3B and 3C. A grip encloses a disk onto the chisel shaft in FIG. 3A. Instead of a cushion grip, a grip, serving the functions of cap and grip, normally molded, is slid down over the shaft, preferably by friction fit, which shaft has the disk poised on the striking end.
Figure 3B:
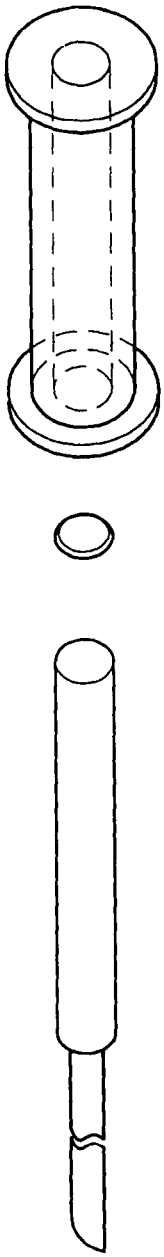
Figure 3C:
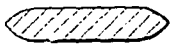
Figure 4:
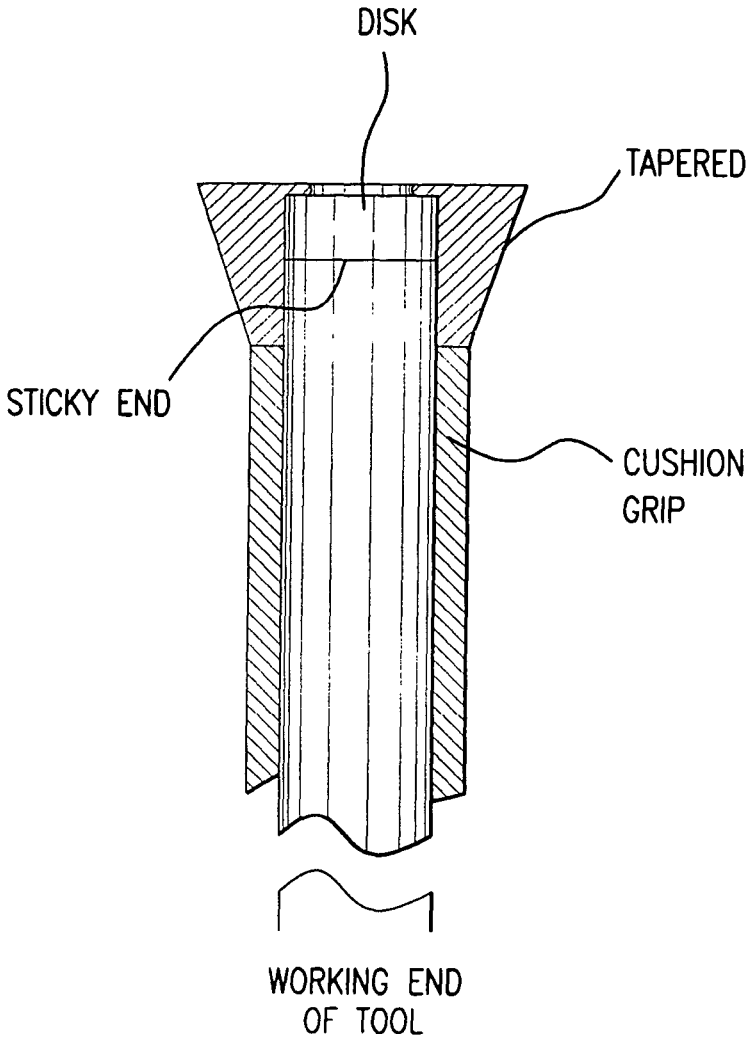
FIG. 4, a disk and cap as described are utilized, and a cushion grip, preferably in the form of a round, friction-fitting cushion tube is slid on the shaft to soften the feel of the tool in hand and enable more effective gripping by the hand. An upper tapered portion of the shaft and striking end is shown.
Figure 5A:
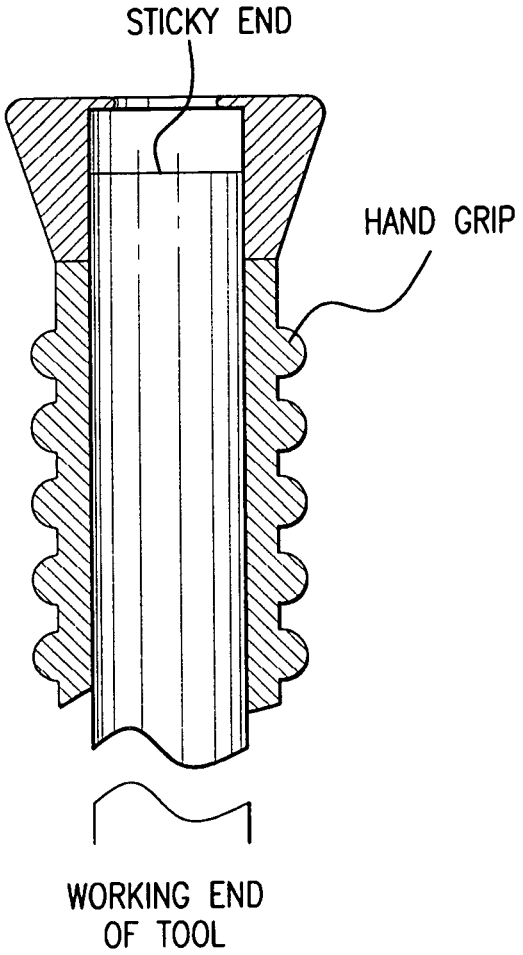
FIG. 5 shows a handgrip with a disk which can be made sticky for manufacturing and secured by a hand grip with contours on the grip.
Figure 5B:
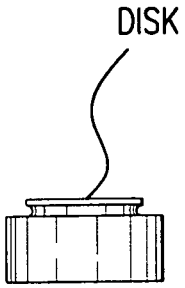

In a preferred mode, see FIG. 4, a disk and cap as described are utilized, and a cushion grip, preferably in the form of a round, friction-fitting cushion tube is slid on the shaft to soften the feel of the tool in hand and enable more effective gripping by the hand. The disk in the figures is either flared, or as shown in FIG. 4, has a lip with a circumference equal to the shaft diameter. See, for example FIG. 5B. Alternatively, and in current models, the disk is flat with a slightly elliptical perimeter. Put another way, the preferred mode of disk uses a sort of football or curved conical perimeter which fits into and under the cap as shown in FIGS. 3B and 3C. Alternatively a frustrum shape to the disk with the wider radius of the frustrum to the striking end of the tool and the narrower end secured to the impact tool by the cap also is practical.

Figure 7:
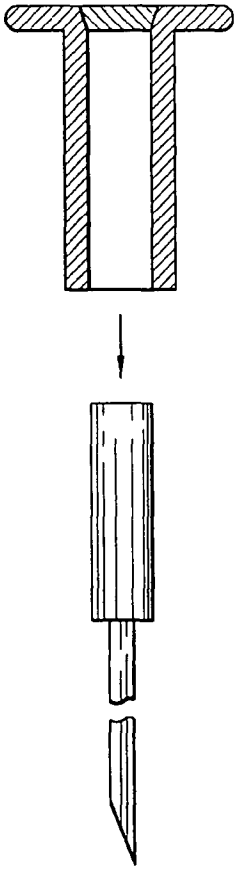
FIG. 7 shows a disk that would normally require adhesive to be used because the wider part of the disk is away from the tool.

The disk is placed on the shaft. A polygonal or circular cap fits over the end of the shaft on which the disk is placed to secure the disk in place and to provide overstrike protection to hand and fingers. The cap may have a flared top to provide a larger striking face and target as shown in FIG. 4. In that cap is an aperture through which the disk may be struck, or through which the disk may protrude. FIG. 7 shows potential pre-assembly disposition of the parts. Alternatively, the surface of the disk away from the striking end may be planar to the surface of the grip. The tool is struck on the disk to drive it to the tool's object. The cap secures the disk from lateral motion. In the preferred mode, the disk surface away from the striking end is just above the surface of the grip, and is of a different color to direct the eye and hopefully the hand-eye coordination to a more accurate strike. The cap may be of a softer material than the disk. The grip can be made of foam or comfortable material and may have a hand grip molded into it.

Figure 2:
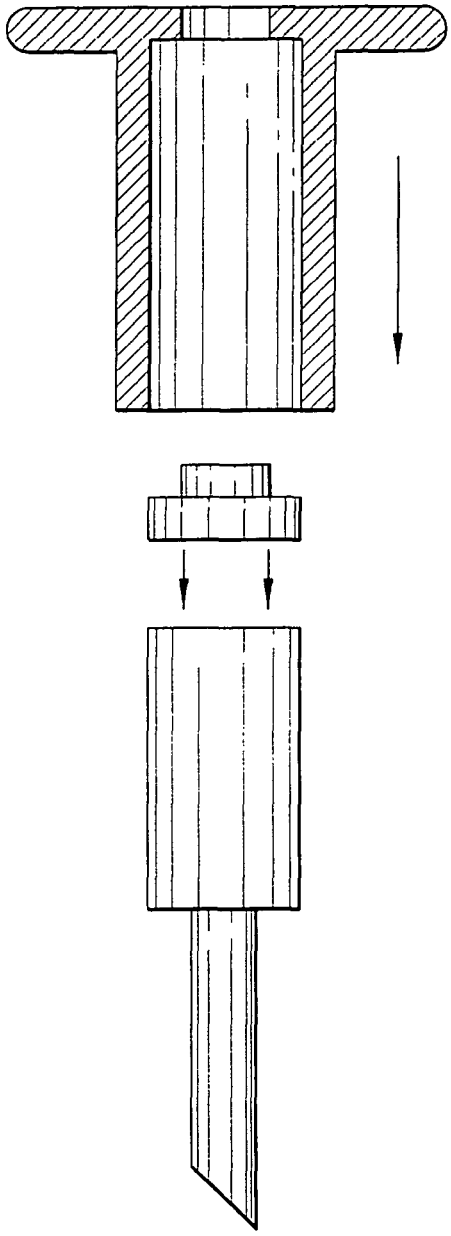
FIG. 2 shows a disk placed over a shaft with a cylindrical shape interior to the disk of small diameter which fits into an aperture in a cap with the cylindrical shape fitting into the aperture in the cap which is slid over the shaft of the chisel.

Alternatively, in another preferred mode, a disk as described is utilized. Enclosing the disk onto the shaft would be a grip. See Figures in FIG. 3, especially FIGS. 3A and 3B, and 5A. Instead of a cushion grip, a grip, serving the functions of cap and grip, normally molded, is slid down over the shaft, preferably by friction fit, which shaft has the disk poised on the striking end. The disk is then secured by the grip from lateral motion, and the shaft is surrounded by a grip of sufficient diameter to enable the chisel to be comfortably held. The grip would have an aperture through which the disk may be struck, or through which the disk may protrude. FIG. 2 shows an exploded view of the potential pre-assembly posture of the parts. Alternatively, the surface of the disk away from the striking end may be planar to the surface of the grip. In the preferred mode, the disk surface away from the striking end is just above the surface of the grip, and is of a different color to direct the eye and hopefully the hand-eye coordination to a more accurate strike. The grip may be of a softer material than the disk.

The grip may also have a collar at the lower end away from the striking end toward the working end which prevents the hand from sliding down the grip to the work and furnishes a more comfortable hold. See FIG. 3.

Figure 6:
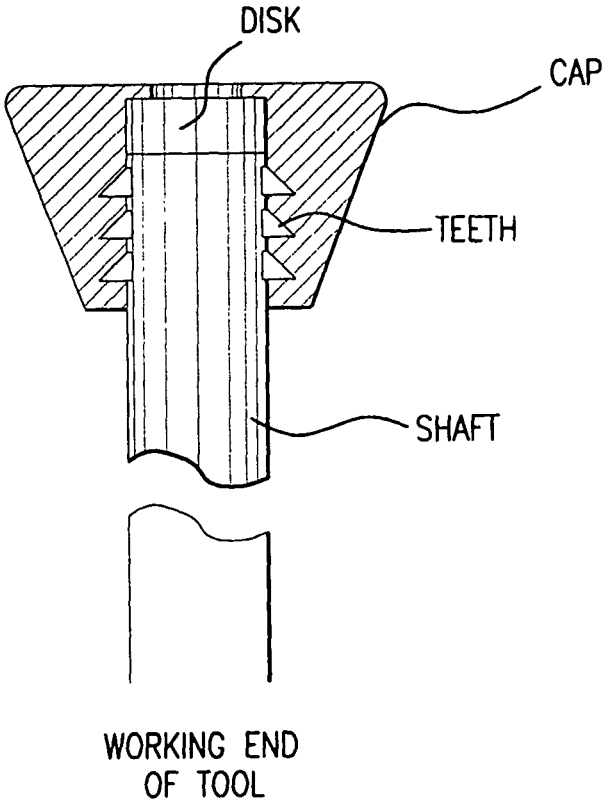
FIG. 6 shows how, in addition or as an alternative to friction fit, teeth on the tool shaft, or a roughed surface may be utilized to hold the grip.

FIG. 6 shows how, in addition or as an alternative to friction fit, teeth on the tool shaft, or a roughed surface may be utilized to hold the grip.

Figure 8:
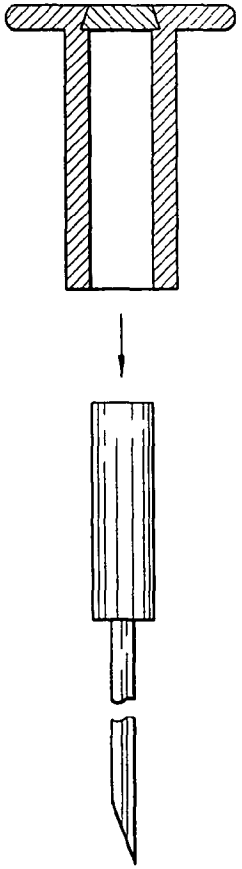
FIG. 8 shows the narrower end of a flared disk disposed away from the striking end of the tool.

FIG. 7 shows a disk that would normally required adhesive to be used because the wider part of the disk is away from the tool. FIG. 8 shows the narrower end of a flared disk disposed away from the striking end of the tool.

Figure 9:
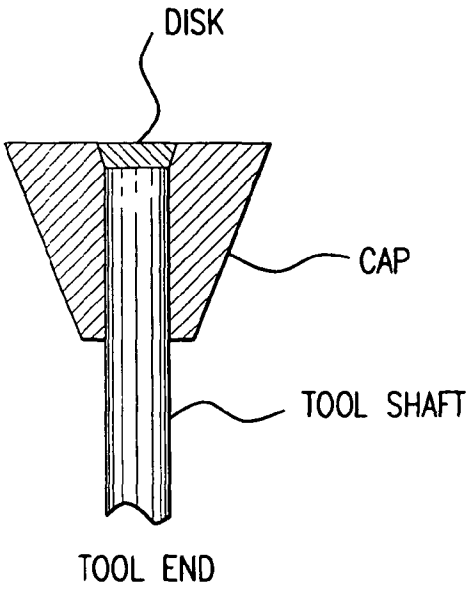
FIG. 9 is the simplest design with no grip at all, but a cap to give some overstrike protection and the disk secured by the cap useable for protection from spalling.
Figure 10C:
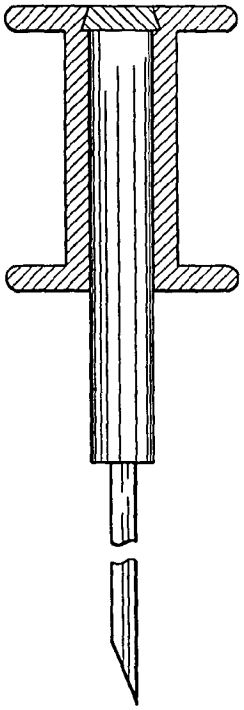
FIGS. 10A, 10B, and 10C have several different grips shown with the narrower end of a flared disk disposed away from the striking end of the tool in Tool 10A
Figure 10B:
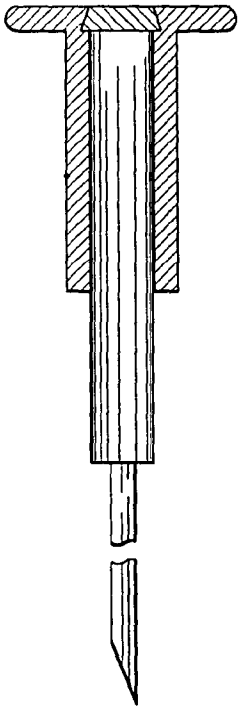
Figure 10A:
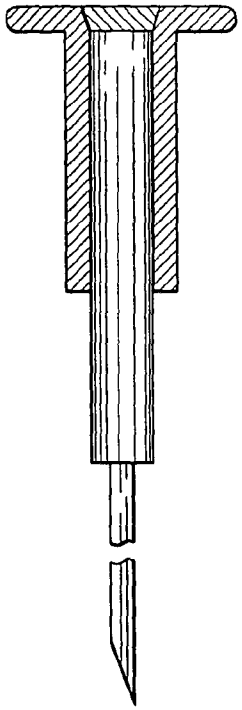
Figure 11B:
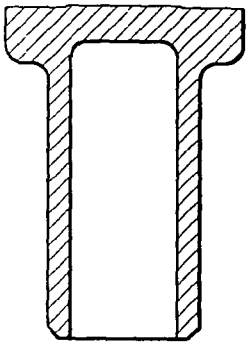
FIG. 11 shows the tool with rounded metal surfaces on the top of the chisel to slow crack propagation.
Figure 11C:
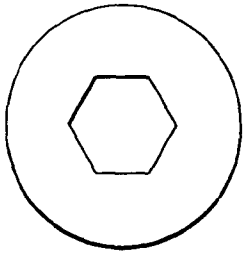
Figure 11A:
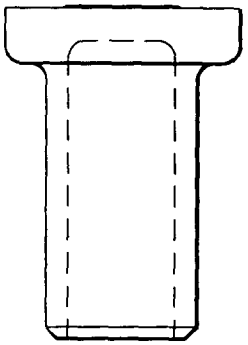
Figure 12A:
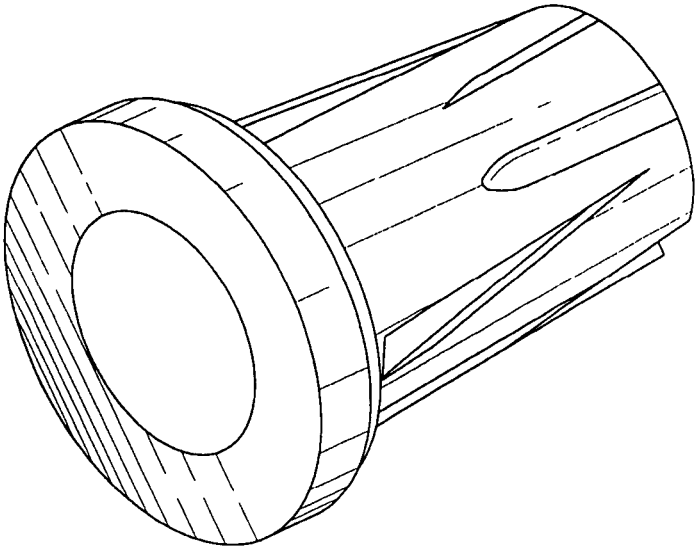
FIG. 12 shows a one piece manufactured cap to fit over a chisel.
Figure 12B:
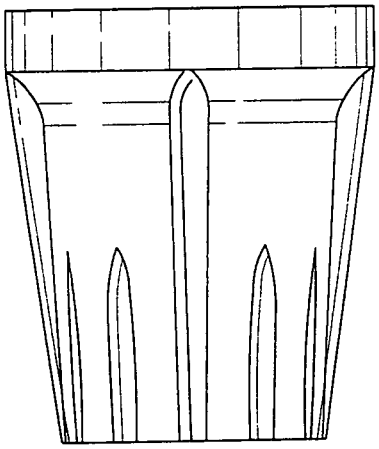

FIG. 9 is the simplest design with no grip at all, but a cap to give some overstrike protection and the disk secured by the cap useable for protection from spalling. FIGS. 10A, 10B, and 10C have several different grips shown with the narrower end of a flared disk disposed away from the striking end of the tool.

The advantages of this mode of the invention with the larger cushion grip are that a normal chisel shaft is considerably smaller than a person's hand and the grip enables the person to comfortably and more safely hold the chisel, in part by increasing the holding torque. The cushion grip reduces the shock to the hand and minimizes injury such as carpal tunnel or other fatigue syndrome. The invention has the advantage of redistributing vibration to lower frequencies. This applies to both aural vibration, meaning the ear is not exposed to the high pitched ring of the hammer on chisel, and to lower level vibrations of the shaft which is easier on the body. The hand feels a sense of dampening. The preferable cushion grip is a synthetic elastic material that is oil and grease resistant. There can be a disk, a cap, or a cap with flange and grip.

The grip may also have a collar at the lower end away from the striking end toward the working end which prevents the hand from sliding down the grip to the work and furnishes a more comfortable hold.

The grip may be tapered.

MINLON has been tested in the preferred mode of application with a cold chisel in a machine with a one lb. hammer accelerated to 50 ft/sec$^2$, cutting ¼ inch drill rod, to 3000 strikes with no apparent effect on either cutting effectiveness of the impact tool, nor appearance of the impact tool.

The striking end may be champfered.

In a more complex mode, the grip may have the cap integrated with the grip. Even more complex is, in a complex injection mold, to insert the mineral or mineral-reinforcing, flow in the MINLON in the area to be adjacent to the striking end of the impact tool, and then flow in the ADIPRENE to fill out the rest of the injection mod cap are and grip area.

Another novel aspect of the invention is to use a combination of a more sharply angled cutting edge with slightly lower modulus material for the disk. If the cutting edge is too sharp an angle and the force transmitted is too high, the edge degrades too rapidly. Thus, this invention by selection of material for the disk enables a sharper angle to the cutting edge, and correspondingly faster cutting for the sharper angle. Test results indicate that the slightly lower impact force in a given tool resulting from the use of the MINLON disk enables an adjustment to a 60 degree inclusion angle from a standard 65-70 degree angle with effectiveness only declining from 12 cutting blows for a standard-angled tool without a MINLON disk to 13 cutting blows for a 60-degree angled tool with the MINLON disk. The degradation that might occur on the sharper angled tool does not occur because some energy is lost because of the disk. This is also applicable to repeated impact tools.

Multiple caps for different grips may be utilized. For the cap over the disk, in the preferred mode with the disk protruding, the materials HYTRIL, PELRIN, ATAPRENE, NYLON, polypropylene or DACRON may be used.

With respect to the use of the invention in ajackhammers, normally the bit or working portion of the jackhammer is interchangeable. As stated before, in a jackhammer, the width of the later described disk would normally be coincident with the diameter of the shaft of the interchangeable working portion of the jackhammer. The jackhammer ram would strike the disk. There would be significant noise reduction. The invention also contemplates the use in a jackhammer of the same material, MINLON, to line the retaining ring, or to be the retaining ring, that aligns, the working portion of the jackhammer which is being rammed by a jackhammer ram. Noise reduction occurs by reducing the noise of the working portion of the jackhammer rattling in the end of the jackhammer from which the working portion protrudes from the main body of the jackhammer containing the ram.

An alternative combination of preferred mode involves a method of manufacture resulting in a novel combination in a one-piece cap for an impact tool. There are two approaches. First, the disk may be manufactured as previously described. A less expensive material for the cap or grip being used as cap and grip can be selected with a lower melting point than the material in the disk. The disk can be positioned in the mold, and the selected material for the cap (or grip) flowed into the mold yielding a disk secured in the cap (or grip). Second, using an injection molding process, a reinforcing fiber is secured, preferably by adhesive, in a centered position (referred to as "the center of the mold" regardless of its actually position in the mold; the reference being to the final cap) in that upon completion of molding, cooling and removal from the mold, will result in a fiber reinforced thermoplastic resin portion between the center impact point of a striking device and the body of the tool. The entire mold can be injected with MINLON, with the Nylon 66 component of MINLON permeating the fiber for reinforcement. Alternatively, and more cost effectively, the "center of the mold" can be initially injected with MINLON by DuPont of Wilmington, Del., and the remainder of the mold for a particular cap with ADIPRENE developed by DuPont and produced by UniRoyal Chemical, cataloged as LF 753D. Although the order of injection, i.e. from the outside to the center can be reversed, the inventors believe the initial injection of MINLON is preferable. The resulting combination is a tool, with a one piece cap having a reinforced center of MINLON, and the shaft with a working end, and the other striking end with the one piece cap, can be made with or without a grip. Further, the mold can be enlarged so that the entire cap and grip are made of ADIPRENE with the fiber reinforced center of the tool.

Alternatively, thermosetting materials can be molded into the cap, or thermoplastic materials molded in according to standard techniques known to those reasonably skilled in the arts related to those materials.

The first method of manufacturing is to slide the cushion grip on the tool, place the disk on the tool and then mount the cap on the tool. A second method of manufacturing is to place the disk on the tool and then mount the described grip on the tool.

A label may be put on the grip or the cap or both, or on the disk.

The invention, using the cap or the grip is also suitable for display.

The invention is not meant to be limited to the disclosures, including best mode of invention herein, and contemplates all equivalents to the invention and similar embodiments to the invention.

We claim:

1. An impact tool for use on stone, concrete, metal or similarly hard material comprising:

a shaft having a striking end and a working end; and a shaped polymeric material, reinforced by a material selected from the group of fiber or mineral, to be impacted, disposed immediately adjacent to said striking end in order to avoid direct metal-to-metal contact and in order to eliminate any loss of energy or damage to said shaped reinforced polymeric material from any gap between said shaped polymeric material and said striking end, said shaped polymeric material having a striking end area of said polymeric material adjacent to said striking end and an impact end area to be impacted roughly opposite said striking end area, said shaped polymeric material being of sufficient cross-sectional area for transmitting impact upon the impact end area, of appropriate thickness through said cross-sectional area, and of sufficient modulus to enable greater than sixty-seven per cent impact effectiveness compared to a similar impact tool without said polymeric material disposed adjacent to said striking end, said impact tool further being capable of being struck on said impact end area at least 250 times without deformation of said shaped polymeric material that alters said impact effectiveness of said impact tool, and said impact tool further being capable of use on stone, concrete, metal or similarly hard material.

2. The impact tool according to claim 1, further comprising:

said shaped polymeric material being selected to have the further characteristic of redistributing the sound frequency on impact by a driving force on said impact tool to lower frequency ranges than said impact tool without said shaped polymeric material so that resulting sound and vibration is of lower dB, and less harmful frequency ranges to humans.

3. The impact tool according to claim 2 comprising:

said working end being a chisel having an angle less than the standard 65-70 degree chisel angle; and, said shaped polymeric material being of sufficient cross-sectional area for transmitting impact upon the impact end area, of appropriate thickness through said cross-sectional area, and of sufficient modulus to enable greater than sixty-seven per cent impact effectiveness compared to a similar impact tool without said shaped polymeric material and having a standard 65-70 degree chisel angle.

4. An impact tool comprising:

a shaft having a striking end and a working end; and a shaped fiber-reinforced polymeric material being a polymeric material to be impacted having a shape and disposed adjacent to said striking end to avoid direct metal-to-metal contact, said shaped fiber-reinforced polymeric material having a striking end area of said polymeric material adjacent to said striking end and an impact end area to be impacted roughly opposite said striking end area, said shaped fiber-reinforced polymeric material being of sufficient cross-sectional area for transmitting impact upon the impact end area, of sufficient thickness through said cross-sectional area, and of sufficient modulus calculated according to the following formula:

said modulus times said cross-sectional area for transmitting impact upon the impact end area divided by said thickness through said cross-sectional area=X X to be of a value to enable greater than sixty-seven per cent impact effectiveness compared to a similar impact tool without said fiber-reinforced polymeric material disposed adjacent to said striking end.

5. The impact tool according to claim 4, further comprising:

said shaped polymeric material being selected to have the further characteristic of redistributing the sound frequency on impact by a driving force on said impact tool to lower frequency ranges than said impact tool without said shaped polymeric material so that resulting sound and vibration is of lower dB, and less harmful frequency ranges to humans.

6. The impact tool according to claims 4 or 5, further comprising:

said shaped polymeric material being selected from the group of polymeric materials reinforced by fiber or mineral.

7. The impact tool according to claim 2 comprising:

said working end being a chisel having an angle less than the standard 65-70 degree chisel angle; and, said shaped fiber-reinforced polymeric material being of sufficient cross-sectional area for transmitting impact upon the impact end area, of appropriate thickness through said cross-sectional area, and of sufficient modulus to enable greater than sixty-seven per cent impact effectiveness compared to a similar impact tool without said shaped polymeric material and having a standard 65-70 degree chisel angle.

8. The impact tool according to claim 1, 2, 3, 4, 5, or 7, further comprising:

said shaped polymeric material being shaped so that no edge or surface is presented having a radius of curvature of less than 0.02 inches.

9. An impact tool for use on stone, concrete, metal or similarly hard material comprising:

a shaft having a striking end and a working end; and a shaped polymeric material, reinforced by a material selected from the group of fiber or mineral, to be impacted, disposed immediately adjacent to said striking end in order to avoid direct metal-to-metal contact and in order to eliminate any loss of energy or damage to said shaped reinforced polymeric material from any gap between said shaped polymeric material and said striking end, said shaped fiber-reinforced polymeric material having a striking end area of said polymeric material adjacent to said striking end and an impact end area to be impacted roughly opposite said striking end area, said shaped fiber-reinforced polymeric material being of sufficient cross-sectional area for transmitting impact upon the impact end area, of appropriate thickness through said cross-sectional area, and of sufficient modulus in order to maintain impact effectiveness while inhibiting failure of said shaped polymeric material upon impact, and further being shaped so that no edge or surface is presented having a radius of curvature of less than 0.02 inches, said impact tool further being capable of being struck on said impact end area at least 250 times without deformation of said shaped polymeric material that alters said impact effectiveness of said impact tool, and said impact tool further being capable of use on stone, concrete, metal or similarly hard material.

10. The impact tool according to claims 9, further comprising:

said shaped polymeric material having support ridges on said shaped polymeric material circumferentially located around said shaft adjacent to said striking end.

11. The impact tool according to claims 10, further comprising:

said shaped polymeric material being at least one material selected from the group of polymers including polyamide, polyester, polyurethane, polypropylene, polycarbonate.

12. The impact tool according to claim 1, 2, 3, 4, 5, 7, 9, or 10, further comprising:

said shaped polymeric material being comprised of at least one polyamide.

13. The impact tool according to claim 1, 2, 3, 4, 5, 7, 9, or 10, further comprising:

said shaped polymeric material being comprised of at least-fiber-reinforced nylon.

14. The impact tool according to claim 1, 2, 3, 4, 5, 7, 9, or 10, further comprising:

said shaped polymeric material being shaped to extend beyond the cross-sectional area of said impact end area.

15. The impact tool according to claim 1, 2, 3, 4, 5, 7, 9, or 10, further comprising:

said shaped polymeric material being at least partially surrounding by a grip, and said grip also partially encasing said shaft.

16. The impact tool according to claim 1, 2, 3, 4, 5, 7, 9, or 10, further comprising:

said shaped polymeric material being at least partially surrounded by a grip, and said grip having a flange for hand protection.

17. The impact tool according to claim 1, 2, 3, 4, 5, 7, 9, or 10, further comprising:

said impact tool having a second shaped polymeric material being shaped to extend beyond the cross-section area of said impact end area and having an aperture exposing said impact end area.

18. The impact tool according to claim 1, 2, 3, 4, 5, 7, 9, or 10, further comprising:

said impact tool having a second shaped polymeric material being shaped to extend beyond the cross-section area of said impact end area and having an aperture exposing said impact end area and said second shaped polymeric material being removable.

19. The impact tool according to claim 1, 2, 3, 4, 5, 7, 9, or 10, further comprising:

said impact tool having a second shaped polymeric material being shaped to extend beyond the cross-section area of said impact end area and having an aperture exposing said impact end area and said second shaped polymeric material being removable; and said second shaped polymeric material functioning as a cap and being composed of material inhibiting failure, including spalling failure.

20. The impact tool according to claim 1, 2, 3, 4, 5, 7, 9, or 10, further comprising:

said impact tool having a second shaped polymeric material being shaped to extend beyond the cross-section area of said impact end area and having an aperture exposing said impact end area and said second shaped polymeric material being removable; and said second shaped polymeric material functioning as a cap and being composed of material inhibiting failure, and said material inhibiting failure being selected from the group of polymeric materials reinforced by fiber or mineral.

21. The impact tool according to claim 1, 2, 3, 4, 5, 7, 9, or 10, further comprising:

said impact tool having a second shaped polymeric material being shaped to extend beyond the cross-section area of said impact end area and having an aperture exposing said impact end area and said second shaped polymeric material being removable; and said second shaped polymeric material functioning as a cap and being composed of material inhibiting failure.

* * * * *